United States Patent [19]

Gelin

[11] 3,987,456

[45] Oct. 19, 1976

[54] WIDE RELATIVE FREQUENCY BAND AND REDUCED SIZE-TO-WAVELENGTH RATIO ANTENNA

[75] Inventor: Jean Gelin, Eaubonne, France

[73] Assignee: Lignes Telegraphiques et Telephoniques, Paris, France

[22] Filed: July 21, 1975

[21] Appl. No.: 597,679

[30] Foreign Application Priority Data

Aug. 1, 1974 France ..... 74.26708

[52] U.S. Cl. ..... 343/830; 343/846; 343/773

[51] Int. Cl.[2] ..... H01Q 9/16

[58] Field of Search ..... 343/795, 797, 799, 804, 343/845, 846, 773, 790, 791, 774, 703, 861, 775, 830, 831

[56] References Cited

UNITED STATES PATENTS

| | | | |
|---|---|---|---|
| 2,368,663 | 2/1945 | Kandoian | 343/773 |
| 2,802,209 | 8/1957 | Scheideler | 343/791 |
| 3,618,107 | 11/1971 | Spanos | 343/846 |
| 3,787,865 | 1/1974 | MacDowell et al. | 343/773 |

FOREIGN PATENTS OR APPLICATIONS

| | | | |
|---|---|---|---|
| 821,374 | 11/1951 | Germany | 343/790 |
| 1,130,868 | 7/1960 | Germany | 343/790 |
| 926,599 | 5/1963 | United Kingdom | 343/775 |

OTHER PUBLICATIONS

Electro-Technol. (India) vol. 15, No. 2 (Mar.-Apr. 1971) pp. 57-59, A Wide Band Discone Antenna.

*Primary Examiner*—Alfred E. Smith
*Assistant Examiner*—Tommy P. Chin
*Attorney, Agent, or Firm*—Abraham A. Saffitz

[57] ABSTRACT

A wide relative frequency band and reduced size-to-wavelength ratio antenna comprising essentially a first part in the form of a conductor ring and a second part in the form of a skirt respectively connected to the central and outer conductors of a coaxial feeder. The first part has a conductive path in the form of a circumference and one of its diameters; the central conductor of the feeder is connected to the mid-point of the said diameter. The second part is in the form of a skirt and has a conductive path formed by a circular ring connected to one of the ends of each one of a plurality of conducting strands having the form of broken lines inscribed in isosceles trapezoid forming an assembly defining the faces of a frusto-pyramid, while an annular and conical end member is connected to the feeder outer conductor and is in contact with the other ends of the strands.

9 Claims, 11 Drawing Figures

WIDE RELATIVE FREQUENCY BAND AND REDUCED SIZE-TO-WAVELENGTH RATIO ANTENNA

This invention relates to a wide relative frequency band and reduced size antenna structure capable of omnidirectionally radiating linearly polarized electric fields and, the general form of which is close to that of so-called discone antennas as described for the first time by A. G. KANDOIAN in U.S. Pat. No. 2,368,663 filed May 15, 1943. The examplified embodiments shown in the latter patent comprise a disc and a cone of solid sheet metal.

In an article entitled "A wide band discone antenna" published on page 57 of the March-April 1971 issue of the Indian journal "Electro-Technology", V. Lakshminarayana, Yog Raj Kubba and Me Madhusedan describe a discone transmission antenna wherein hollow conductors having an outside diameter of a few millimeters replace the metal sheets. Other derived antenna constructions are given in the technical literature. Rules relating to the dimensioning of such antennas are given, for instance, in an article by J. J. NAIL published in the American review "Electronics", August 1953, pages 167 to 169. In these antennas, the length of the generatrices of the cone and the diameter of the disc closely are related to the wavelength in the operating frequency band.

The object of this invention is an antenna having for a given operating wavelength range a substantially smaller size than that of the above-mentioned antennas and with a relative frequency operating range of about 1 octave.

An antenna according to the present invention connected to a coaxial feeder comprises the following elements:

- a first circular conductor;
- a set of strand-shaped lateral conductors folded along broken lines so that the reversal points of said lines are situated on the non-parallel sides of trapezoid contained in the side surfaces of a frusto-pyramid, each of said lateral conductors having a first end connected to the above-said first circular conductor, said lateral conductors having their second ends located at a small spacing from the plane of said side surfaces at their second ends and then being situated closer together;
- a solid conical end member pierced at its center and connected to said second ends of the lateral conductors and to the outer conductor of said coaxial feeder; and
- a second circular conductor connected to a conductor disposed along a diameter and of said second circular conductor and itself connected to the inner conductor of said coaxial feeder.

According to one embodiment of the invention, the conductors are formed from a fine wire and mechanical rigidity of the antenna is provided by embedding the metal structure in a volume of polyurethane foam contained in a polyvinyl chloride casing.

According to another embodiment of the invention, the conductors are made in the form of printed circuits, each of the substrates of which defines a lateral surface of a frusto-pyramid, the said substrates having a curvature at their narrow end.

Other features and advantages of the invention will be apparent from the following description illustrated in FIGS. 1 to 5 and given by way of example without any limitation intention and wherein:

FIG. 1*a* is a view, partly in cross-section, of an antenna according to the present invention:

FIGS. 1*b*, 1*c*, 1*d* and 1*e* are partial views of the same antenna;

Figure 1A:
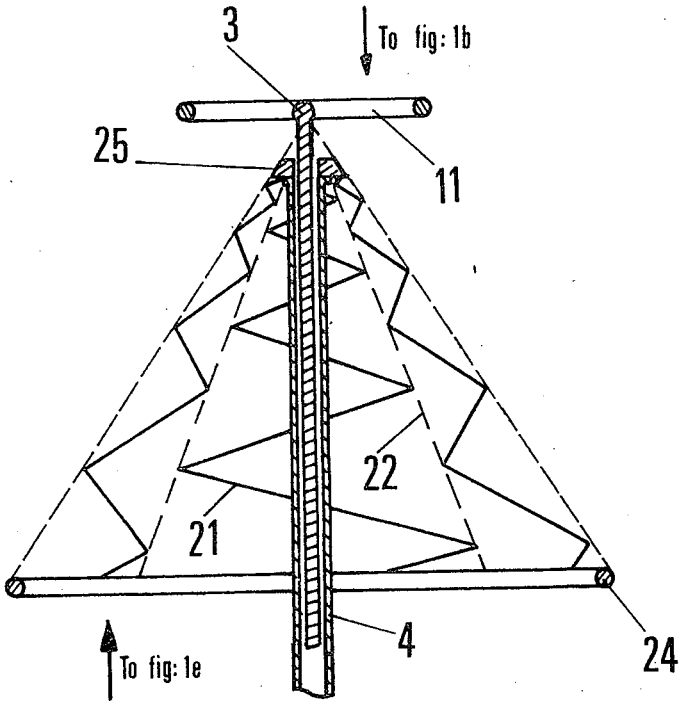
Figure 1B:
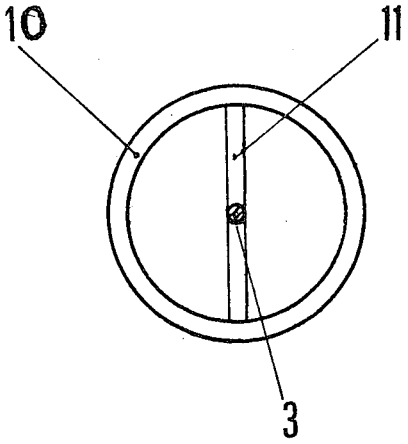

Referring to FIG. 1, the antenna consists essentially of three parts: the first is in the form of an upper conductor 1 and the second has the form of a pyramidal skirt, while the third part consists of the lower circular ring conductor 24. The first one of these parts is connected to the central conductor 3 of a coaxial feeder while the second and third ones are connected to the outer conductor 4 of the same feeder. The upper ring conductor 1 which is shown in plan view in FIG. 1*b*, comprises a conductive structure consisting of a circular ring proper 10 and a diameter 11 thereof, the conductor 3 being connected electrically to the middle of 11. The shape of the skirt is shown in FIGS. 1*c*, 1*d* and 1*e* which respectively illustrate a front view of one of the sides of the frusto-pyramid, an axial section and a bottom end view of the skirt. Each of the faces of the skirt is formed by an approximately plane surface 22 as indicated hereinafter (see FIG. 1*d*) in the form of an isosceles trapezoid. There are six such faces in the example illustrated in FIG. 1. The conductive part of each face is formed by a filiform conductor 21 folded along a broken line, the reversal points 23 of which are situated on the non-parallel sides of the trapezoidal face. As shown in the drawing, the angle between two adjacent segments of the broken line is constant and is shown by reference 2*a* on FIG. 1*c*. The circle circumscribed on the polygon defined by the major bases of the six faces has a diameter close to that of ring 10. The lower ring conductor 24 is connected to the bottom ends of the various conductors 21. The top ends of the conductors 21 are in contact with a solid end member 25 (see FIG. 1*d*) formed by a conical collar connected to the feeder sheath 4. The angle at the apex $\hat{b}$ of the cone associated with 25 may be different from the angle at the apex of the pyramid $\hat{c}$, as shown in exaggerated form in the section in FIG. 1*d*. The faces 22 are then not completely plane. Tests carried out by the applicant with conical end parts having an angle at the apex $\hat{b}$ of 60°, 70°, 80° and 90° have shown that in a frequency band comprised between 130 and 170 % of the lowest frequency of the band, matching of the antenna impedance is easier, at the standard 50 ohm value, when the angle at the apex $\hat{b}$ is greater than $\hat{c}$.

For example, if the angle at the apex $\hat{c}$ of the pyramid is equal to 60°, an optimum result is obtained when the angle at the apex $\hat{b}$ of the associated cone member 25 is close to 80°.

The angle $\hat{c}$, the basis diameter of the conical member 25 of the circle of circumscribed on the basic polygon of the skirt define the axial height of the latter and the dimensions of the trapezoid.

The dimensions of the trapezoid 22 being considered as given, the developed length of the filiform conductor 21 determines the value of the resonant frequency of the radiating strand.

Figure 2:
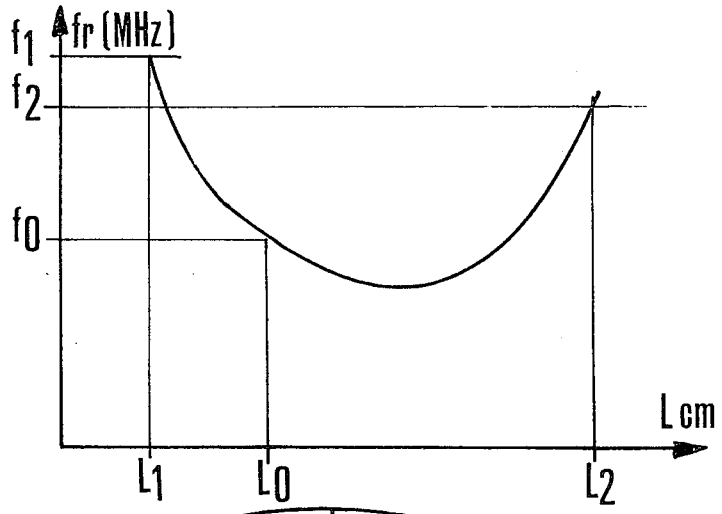
FIG. 2 is a curve showing the variation in resonant frequency of a lateral conductor against its unfolded length.

FIG. 2 shows the variation in resonant frequency *fr* against the total folded length L for a separately taken conductor 21 located in a trapezoidal surface of given dimensions. The measurements were taken by placing the latter conductor against a conductive plane, the height of the trapezoid being perpendicular to said plane and its shorter side close thereto. The impedance was measured between the end of the conductor that would normally be connected to the member 25 and the said conductive plane.

Value *f*1 is the resonant frequency of a wire of a length $L_1$ equal to the height of the trapezoid 22 and value *f*2 is the resonant frequency of a metal sheet cut out along the contour of the trapezoid 22 of height $L_1$.

When L increases from $L_1$, the resonant frequency *fr* firstly decreases and then increases when the segments comprised between the folding points become appreciably closer with increasing values of L. At the limit, when the length L of the conductor 21 has a sufficiently high value $L_2$, the segments are sufficiently close together to ensure electrical continuity on the surface of the trapezoid and the resonant frequency $f_2$ is the frequency that would be measured on one face in sheet metal.

As explained hereinafter, the applicant has produced a six-lateral face antenna adapted to cover the frequency band contained between 225 and 400 MHz the characteristics of which are given below:

| | | |
|---|---|---|
| Diameter of wire used for 10, 11, 21 and 24 | | 1 mm |
| Diameter of ring 10 | | 170 mm |
| Overall diameter at base ring | | 180 mm |
| Length of unfolded conductors 21 | | 1200 mm |
| Angle of apex of pyramid $\hat{c}$ | 60° | |
| Angle $\hat{b}$ of apex of part 25 | 80° | |
| Height of skirt | 145 mm | |
| Weight | 150 g | |

Figure 3:
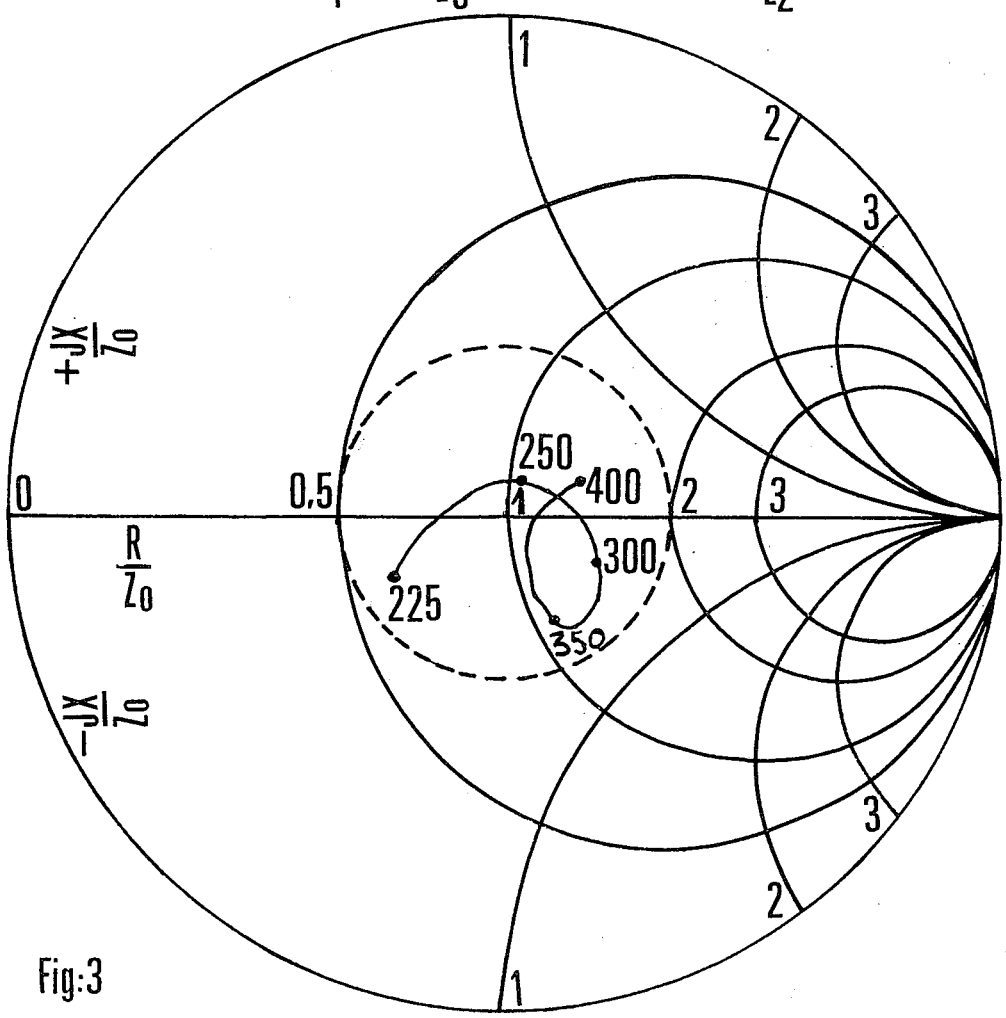
FIG. 3 is a diagram showing the impedance of the antenna against frequency.

FIG. 3 is an impedance diagram showing the values of the ratios of the resistance R and reactance (*jZ*) of the antenna defined above to the characteristic impedance $Z_o$ of the feeder. This figure shows that the standing wave ratio is less than two in the transmission range. By way of comparison, an antenna covering the same band and made in accordance with the prior art (rectilinear lateral conductors forming a cone) has the following mechanical characteristics:

| | |
|---|---|
| Diameter of rods used as conductors | 6 mm |
| Diameter of disc | 390 mm |
| Number of conductors of disc | 12 |
| Diameter at base of skirt | 580 mm |
| Angle at apex of skirt | 70° |
| Height of skirt | 390 mm |
| Number of rectilinear conductors of skirt | 12 |
| Weight | 2 kg |

A comparison between these characteristics and those of the antenna produced according to the invention and described above will show that the latter has 1/25 of the volume and 1/13 of the weight of the antenna of the prior art.

Figure 4:
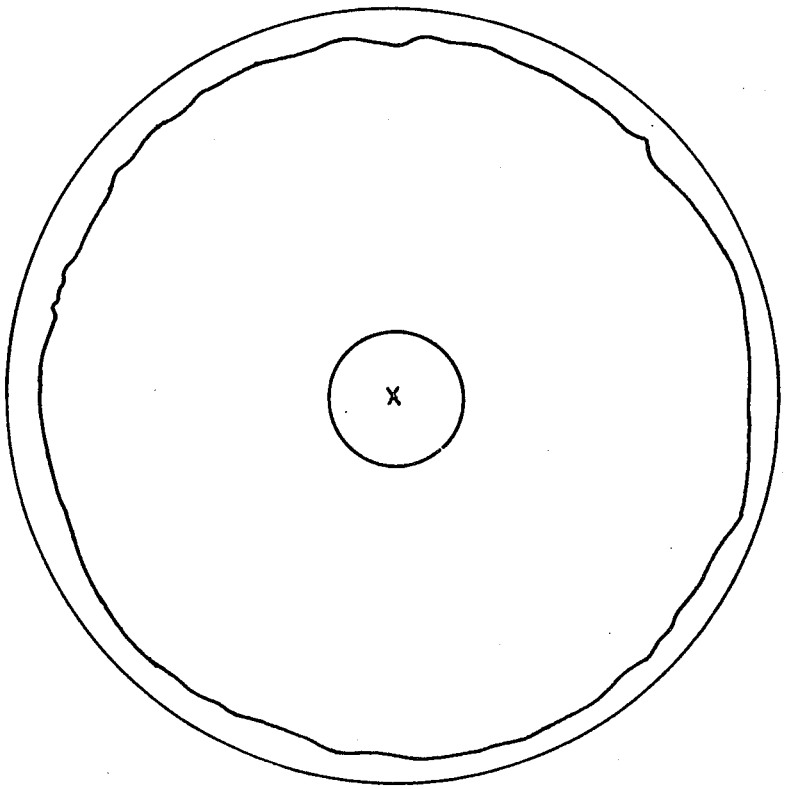
FIG. 4 is a diagram showing the radiation of the antenna plotted in a plane perpendicular to the axis of symmetry of the antenna at a frequency of 300 MHz.

FIG. 4 is a diagram showing the radiation of the antenna plotted in a plane perpendicular to its axis of symmetry, showing that the radiation is omnidirectional.

Figure 5:
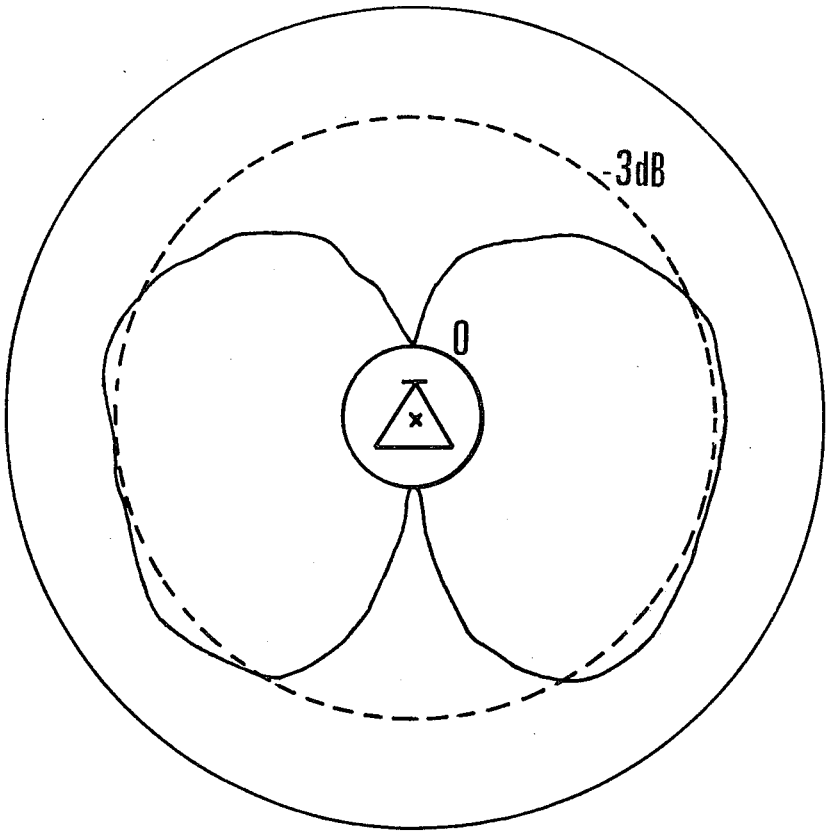
FIG. 5 is a radiation diagram plotted at a frequency of 300 MHz in a meridian plane of the antenna according to the invention.

FIG. 5 is a diagram showing the radiation in a plane containing the axis of symmetry and plotted at the middle frequency of the operating range in the above example.

An alternative embodiment is given in the following table:

| | |
|---|---|
| Diameter of wire used as conductor (10, 11, 21, 24) | 1 mm |
| Diameter of ring 10 | 160 mm |
| Overall diameter of skirt base | 180 mm |
| Length of unfolded conductors 21 | 850 mm |
| Angle of apex of pyramid | 60° |
| Angle of apex of part 25 | 90° |
| Height of skirt | 140 mm |
| Weight | 140 g |

Its electrical characteristics are very close to those of the previous embodiment as regards the radiation diagram. On the other hand, its impedance diagram at a frequency of 225 MHz shows a slightly higher standing wave ratio, although it is still less than two.

To produce an antenna according to the invention with optimum impedance values in the band to be covered, the angle at the apex *c* of the pyramid is preferably made to be 60°.

Figure 1C:
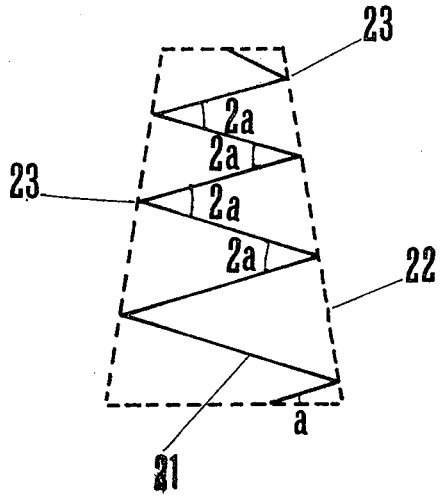
Figure 1D:
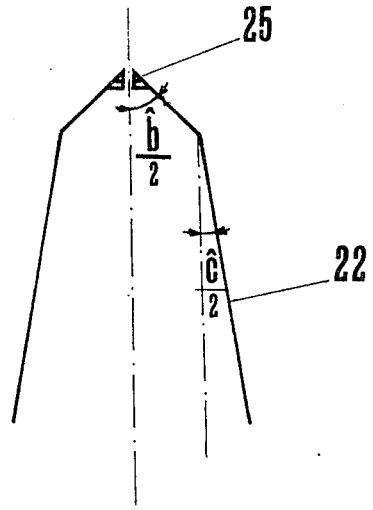
Figure 1E:
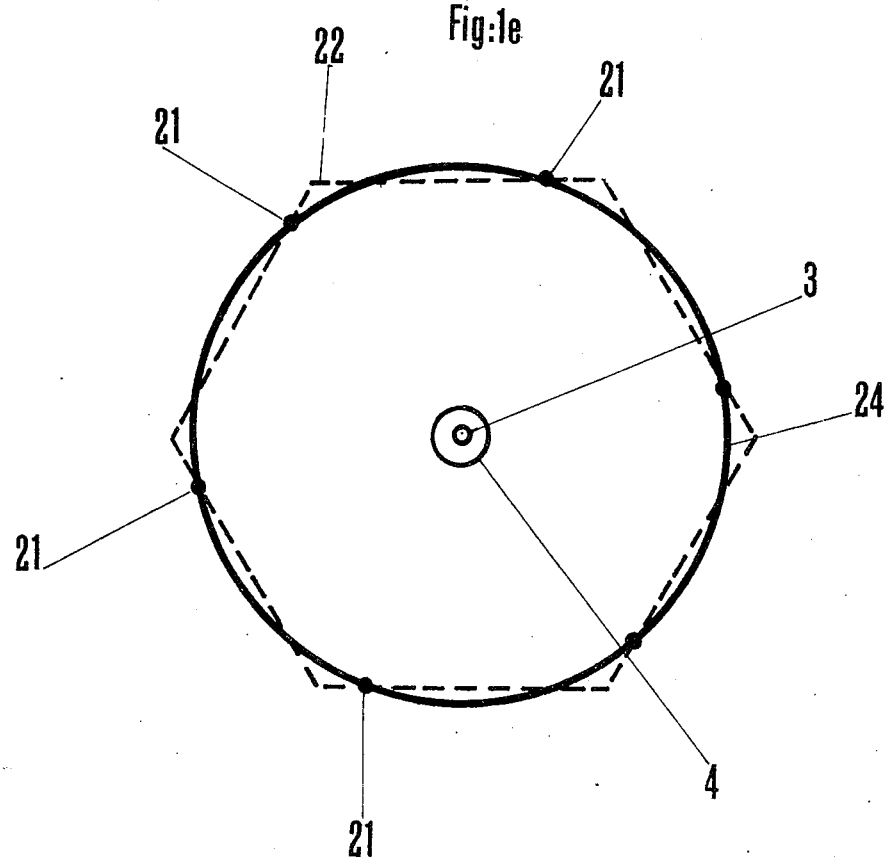

The reduction in size is limited by the practical arrangement of the segments of the conductors 21 at the top part of the skirt because if wire is used it is not possible to keep the bend angle *2a* in FIG. 1*c* constant if the wire length is too great. However, this angle can be slightly reduced without affecting the properties of the antenna. Similarly, where the used conductor is in the form of a printed circuit, an excessive conductor length means a considerable reduction in the width of the metal deposit and hence a reduction in the section and an increase in losses.

The following procedure is necessary to fix the antenna parameters:

The trapezoid must be calculated, the dimensions of which are defined by the angle $\hat{c}$ at the apex of the pyramid (60°), the number of conductors of the skirt, a major base diameter substantially equal to half the wavelength at the bottom frequency of the operating range and a diameter at the apex compatible with the device 25 (FIG. 1) selected for the connection of the conductors of the skirt to the top part of the feeder.

The position of the points giving the constant bending angle *2a* must be calculated for the conductors occupying the surface of the trapezoid as defined above and having different lengths ranging between four-times and 10-times the trapezoid height.

The corresponding conductors must be made of a length such as to allow correct bends to be made at the top part of the trapezoid.

The resonant frequency of each conductor disposed at the center of a ground plane, the transverse dimensions of which are at least equal to one-third of the free space wavelength at the lowest frequency of the operating range, must be plotted. These data are plotted by measuring the impedance between the ground plane and the end of the conductor that would normally be connected to the skirt apex.

The curve representing the variation in the resonant frequency *fr* must be plotted against the length L of the conductor (see FIG. 2).

The length L must be selected which gives *fr* a value of 75 % of the lower limit of the operating range, and the complete skirt is made by joining the bottom ends of the conductors by means of a circular conductor forming a circumference of suitable diameter.

The top end of the skirt conductors must be connected to the outer conductor of the feeder via a part having an angle at the apex $\hat{b}$ equal to 80°. If the conductors are made of wire, their surface viewed in a diametral plane of the assembly has a curved shape. If they are made in the form of printed circuits, the height of the trapezoid will have been reduced by 20 % during calculation thereof and the conductors will be connected to the top part of the pyramid by rectilinear wires.

An upper member (10, 11, FIGS. 1*a* and 1*b*) must be made formed by a ring comprising two diametrically opposite radii connected to the central conductor of the feeder. The diameter of this member must be 95 % of that of the circular conductor placed at the base of the skirt.

Adjustment will be carried out comprising adjusting the diameter of the latter member and the gap between it and the skirt apex.

Figure 6:
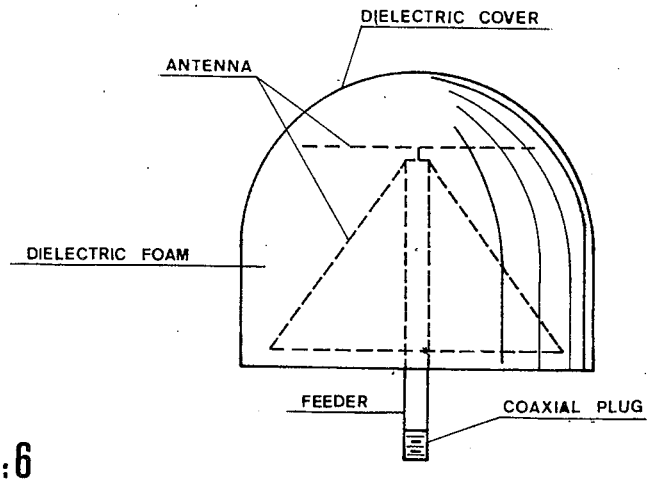
FIGS. 6 and 7 respectively show the various above-defined embodiments of the invention respectively using embedding of the metal structure in polyurethane foam and printed circuits.

As indicated above, the antenna may be protected by embedding it in a volume of polyurethane foam, a polyvinyl chloride casing providing external mechanical protection. This is shown on FIG. 6.

To this end, the antenna is provided with a rigid feeder length greater than the height of the skirt. This feeder, the bottom end of which is provided with a coaxial plug, is connected to the circular end of the cylindrical PVC casing. The liquid preparation is poured through the open top part of this casing. After expansion and stabilisation, the foam is levelled off flush with the top of the cylinder and the disc forming the top part of the casing is stuck on.

Figure 7:
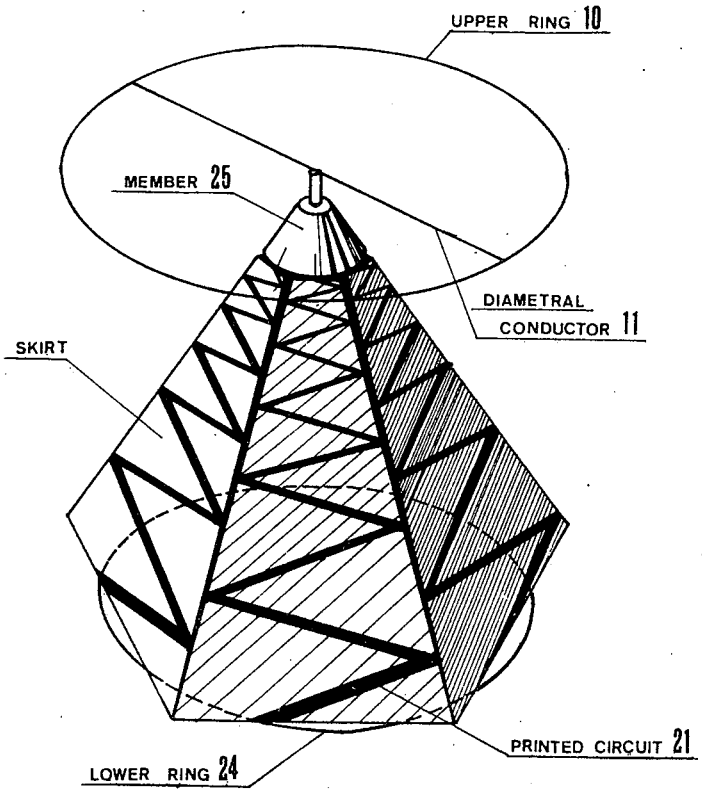

The weight of an antenna produced by this technique is 820 g using a foam having a specific gravity of 28 g/dm$^3$ and a casing, the walls of which are 3 mm thick. FIG. 7 shows the embodiment of the antenna in which the folded conductors inscribed in the trapezoid and forming the skirt are made of printed circuits. FIG. 7 thus shows, in perspective view, the relative arrangement of the upper ring 10, the diametral conductor 11, the conical member 25, the printed conductors 21 and the lower ring 24, already described in connection with FIG. 1a.

What I claim is:

1. A wide relative frequency band and reduced size-to-wavelength ratio antenna comprising a coaxial feeder, a first conducting part in the form of a ring and a second conducting part in the form of a frusto-pyramidal skirt respectively connected to the central and outer conductors of said coaxial feeder, in which said first conducting part includes a conductive path in the form of a circumference and one of its diameters, said central conductor of said feeder to said conducting path being connected to said path at the center of the one of said diameters, in which said second conducting part includes a further conductive path including conducting strands, said further conducting path having the form of a circumference and connected to one of the ends of each one of said conducting strands, and the edges of said conducting strands being respectively inscribed in each one of a plurality of isosceles trapezoids constituting the side faces of said frusto-pyramid; and an annular and conical end member which is connected to said feeder outer conductor and to the other end of said each one of said strands, the assembly of which forms said skirt.

2. An antenna according to claim 1, in which said conductive paths are made of metal wires embedded in a dielectric material.

3. An antenna according to claim 1, in which at least part of said conductive paths are made of printed-circuit conductors.

4. An antenna according to claim 1, in which said frusto-pyramidal skirt has six side faces.

5. An antenna according to claim 1, the conical end member of which has an apex angle close to and greater than that of said frusto-pyramid.

6. An antenna according to claim 1, in which said further conductive path in the form of a circumference is circumscribed on the polygon formed by the base sides of said trapezoid.

7. An antenna according to claim 1, in which said further conductive path in the form of a circumference is inscribed in the polygon formed by the base sides of said trapezoid.

8. An antenna according to claim 1, in which said frusto-pyramid has an apex angle substantially equal to 60° and in which said annular conical end member has an apex angle substantially equal to 80°.

9. An antenna according to claim 1, in which said frusto-pyramid has an apex angle substantially equal to 60° and in which said annular conical end member has an apex angle substantially equal to 90°.

* * * * *